US006499542B1

(12) United States Patent
Greschner

(10) Patent No.: US 6,499,542 B1
(45) Date of Patent: Dec. 31, 2002

(54) ROLLER VEHICLE FOR GROUND COMPACTION

(75) Inventor: Hermann Greschner, Metzingen (DE)

(73) Assignee: Rammax Maschinenbau GmbH, Metzingen (DE)

( * ) Notice: Subject to any disclaimer, the term of this patent is extended or adjusted under 35 U.S.C. 154(b) by 0 days.

(21) Appl. No.: 09/593,579

(22) Filed: Jun. 14, 2000

(30) Foreign Application Priority Data

Jun. 15, 1999 (DE) ..... 299 10 418 U

(51) Int. Cl.[7] ..... E01C 19/26; E02D 3/02
(52) U.S. Cl. ..... 172/175; 405/271
(58) Field of Search ..... 37/142.5, 104, 37/403; 172/40, 175, 125, 668; 404/117, 121, 127, 133.2; 405/271

(56) References Cited

U.S. PATENT DOCUMENTS 2,450,905 A 10/1948 Mork
3,614,867 A * 10/1971 Nieman ..... 61/35
4,023,288 A 5/1977 Roe
4,402,377 A * 9/1983 Brooks et al. ..... 180/197
4,878,544 A * 11/1989 Barnhart ..... 172/40
5,062,228 A * 11/1991 Artzberger ..... 37/117.5
5,526,590 A * 6/1996 Palm et al. ..... 37/142.5
5,676,493 A * 10/1997 Brockway ..... 405/271
5,795,097 A 8/1998 Caron
6,088,644 A * 7/2000 Brandt et al. ..... 701/50

FOREIGN PATENT DOCUMENTS

DE 70 05 609 U 7/1970
EP 0 156 034 A 10/1985

OTHER PUBLICATIONS

Patent Abstracts of Japan vol. 1996, No. 04, Apr. 30, 1996 & JP 07 331611 A, Dec. 19, 1995.
Patent Abstracts of Japan vol. 018, No. 683, Dec. 22, 1994 & JP 06 272210 A, Sep. 27, 1994.

* cited by examiner

*Primary Examiner*—Robert E. Pezzuto
(74) *Attorney, Agent, or Firm*—Michael J. Striker

(57) ABSTRACT

A roller vehicle for ground compaction has a ground compacting device operative for compacting ground; and a levelling device for levelling the ground.

7 Claims, 3 Drawing Sheets

ROLLER VEHICLE FOR GROUND COMPACTION

BACKGROUND OF THE INVENTION

The present invention relates to devices for ground compaction, which are formed as roller vehicles.

Devices of the above mentioned general type are known in the art. Conventional devices for ground compaction are formed so that they exclusively perform compaction of the ground. However such roller vehicles can not provide levelling of unevenness of the ground. For this purpose, additional levelling vehicles are needed to eliminate the ground unevenness before the compaction.

SUMMARY OF THE INVENTION

Accordingly, it is an object of present invention to provide a roller vehicle for ground compaction which eliminates the disadvantages of the prior art.

More particularly, it is an object of present invention to provide a roller vehicle for ground compaction which is designed so that for levelling and compaction of the ground no longer two separate vehicles must be provided.

In keeping with these objects and with others which will become apparent hereinafter, one feature of present invention resides, briefly stated, in a roller vehicle which has means for ground compaction, such as for example a trench roller, and additionally is provided with a levelling device.

When the roller vehicle is designed in accordance with the present invention, the same vehicle can be efficiently used to perform both levelling and compaction of the ground. As a result, the whole process of levelling and compaction can be performed in a shorter time and with lower expenses.

In accordance with a preferable embodiment of the invention, the levelling device of the inventive roller vehicle is formed as a blade.

The levelling device can be movable up and down, for easy maneuvering of the roller vehicle. Moreover, any desirable level of the ground surface can be planned.

In accordance with a further embodiment, the levelling device is movable up and down by means of a lifting device. Therefore the displaced ground can not hindered the levelling device during lifting.

The lifting device in accordance with the present invention can be formed in a structurally especially simple manner, when it includes a telescopable extensible and retractable cylinder unit. The cylinder unit can be driven for example from the available hydraulic system.

When the lifting device lifts the levelling device inclinedly upwardly relative to the vehicle, the levelling unit despite the displaced ground is lifted without a high resistance, since then it is moved back to the vehicle from the displaced ground.

When the levelling device is turned to a horizontal, in particular around its central point, the surface to be leveled can be leveled at any desirable angle to the horizontal.

The levelling device can be mounted on an upper part of the vehicle which is vibrationally uncoupled from the ground compacting part. In this manner, the levelling device is protected from vibrations which result from shaking of the ground compacting part. Therefore damages to the levelling device are avoided.

It is advantageous when in accordance with the present invention, the same hydraulic oil, with which the circuit for producing the vibrations of the compacting part, is used in the circuit for lifting and lowering of the levelling device. For this purpose only one valve is needed, to direct the hydraulic oil in a respective one of the circuits.

The upper part of the compacting part can be clamped so as to prevent that the upper part connected with the levelling device, when the levelling device is oriented inclinedly to a horizontal, is also inclined because of the reaction forces. This can be achieved in an especially simple way by hydraulically operating clamping cylinder.

When desired, the levelling device can be controlled manually and/or remotely. Remote control can be performed for example by radio or infrared light.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
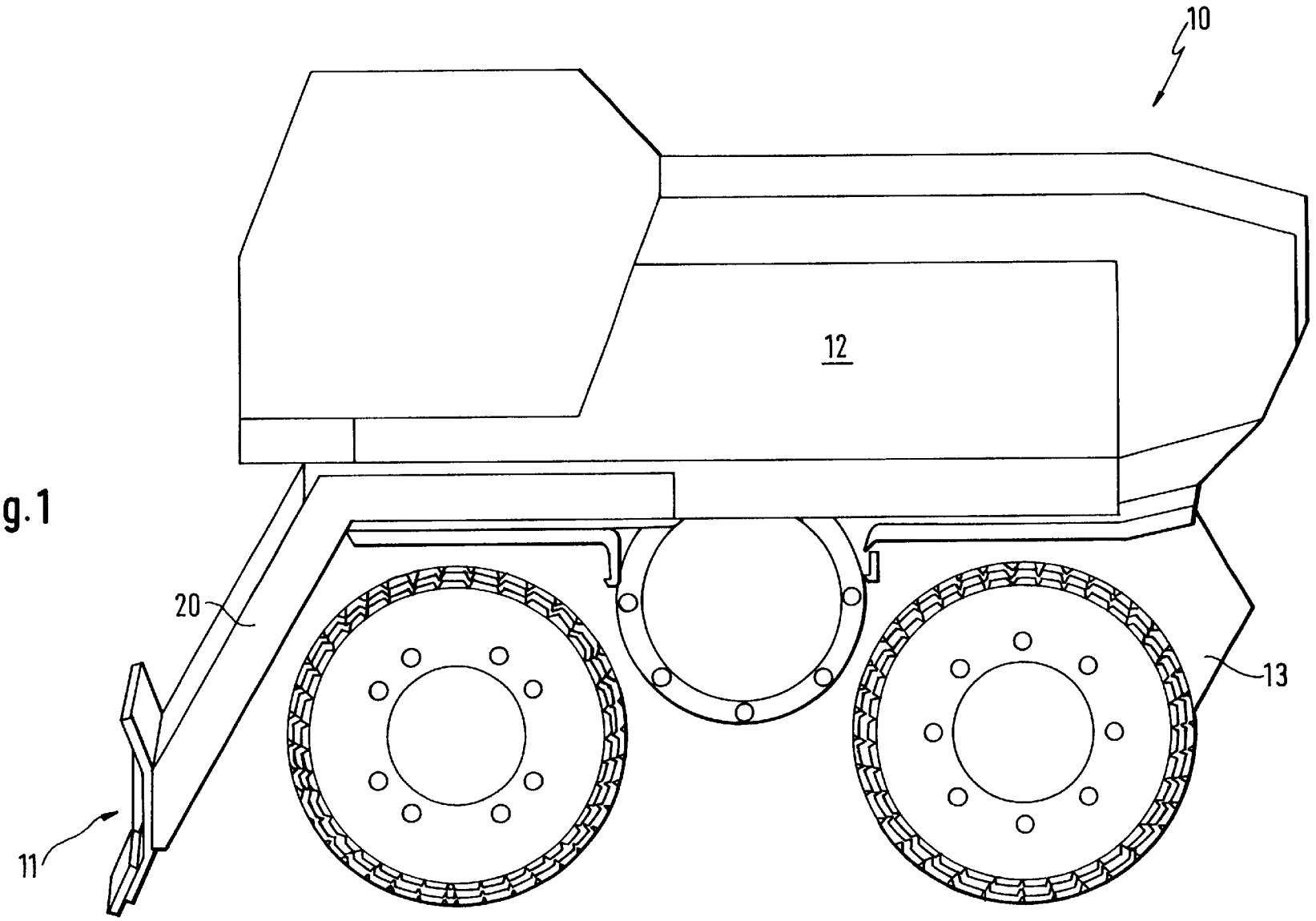
FIG. 1 is a side view of a roller vehicle in accordance with the present invention.

FIG. 1 shows a roller vehicle 10 for ground compaction, in accordance with the present invention.

The roller vehicle 10 is provided at its front end with a levelling device 11. The Levelling device 11 can be formed for example as a blade. For levelling, the levelling device 11 is moved downwardly, and therefore automatically shaking which is required for compaction is prevented. After finishing the levelling works, the levelling device 11 is displaced upwardly. When the blade reaches the upper end position, the shaking drive which is required for ground compacting is automatically released.

The levelling device 11 is mounted on an upper part 12. The upper part 12 is vibrationally uncoupled from a ground compacting part 13. Thereby the levelling device 11 can not be damaged by the shaking of the ground compacting part 13.

Preferably the same hydraulic oil is used in a circuit for producing vibrations of the ground compacting part 13 and also in the circuit for lifting and lowering of the levelling device 11.

The levelling device 11 can be controlled both manually and remotely. Preferably the remote control can be performed by radio or infrared light.

The levelling device 11 can be turned at any angle relative to a horizontal. This is especially important for levelling of surfaces which are inclined at a predetermined angle relative to the horizontal.

In accordance with the invention, the upper part 12 of the ground compacting part 13 is clamped, for example by a not shown clamping cylinder. Therefore during levelling of a surface which is inclined at a predetermined angle relative to the horizontal, the upper part 12 is not inclined. When a linkage 20 is turned upwardly, the levelling device 11 is also turned upwardly. By turning of the linkage 20 downwardly, the levelling device 11 can be lowered. The linkage 20 is driven by a not shown hydraulic cylinder-piston unit.

Figure 2A:
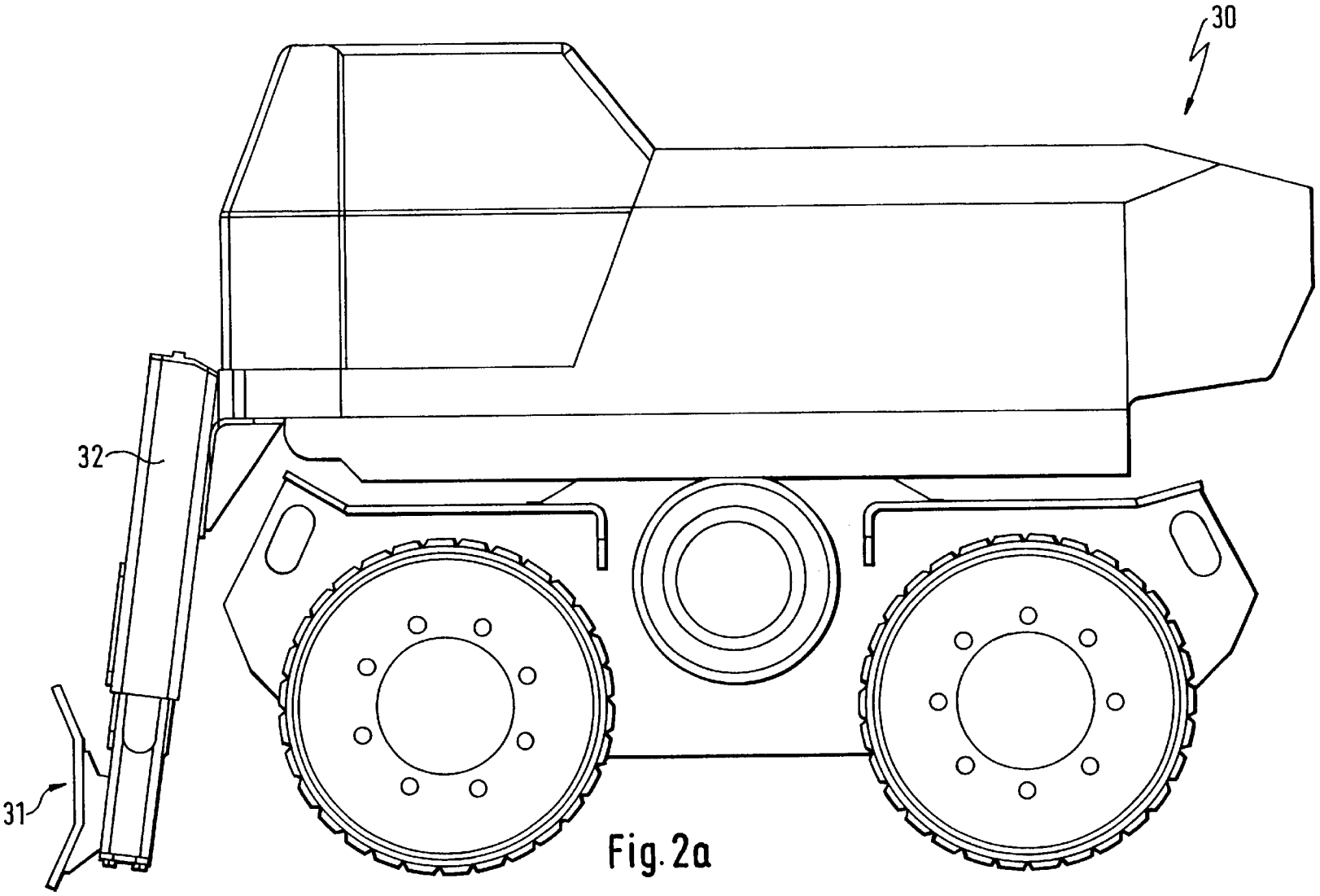
FIGS. 2*a* and 2*b* are perspective view of a further embodiment of a roller vehicle, with levelling devices in different positions.
Figure 2B:
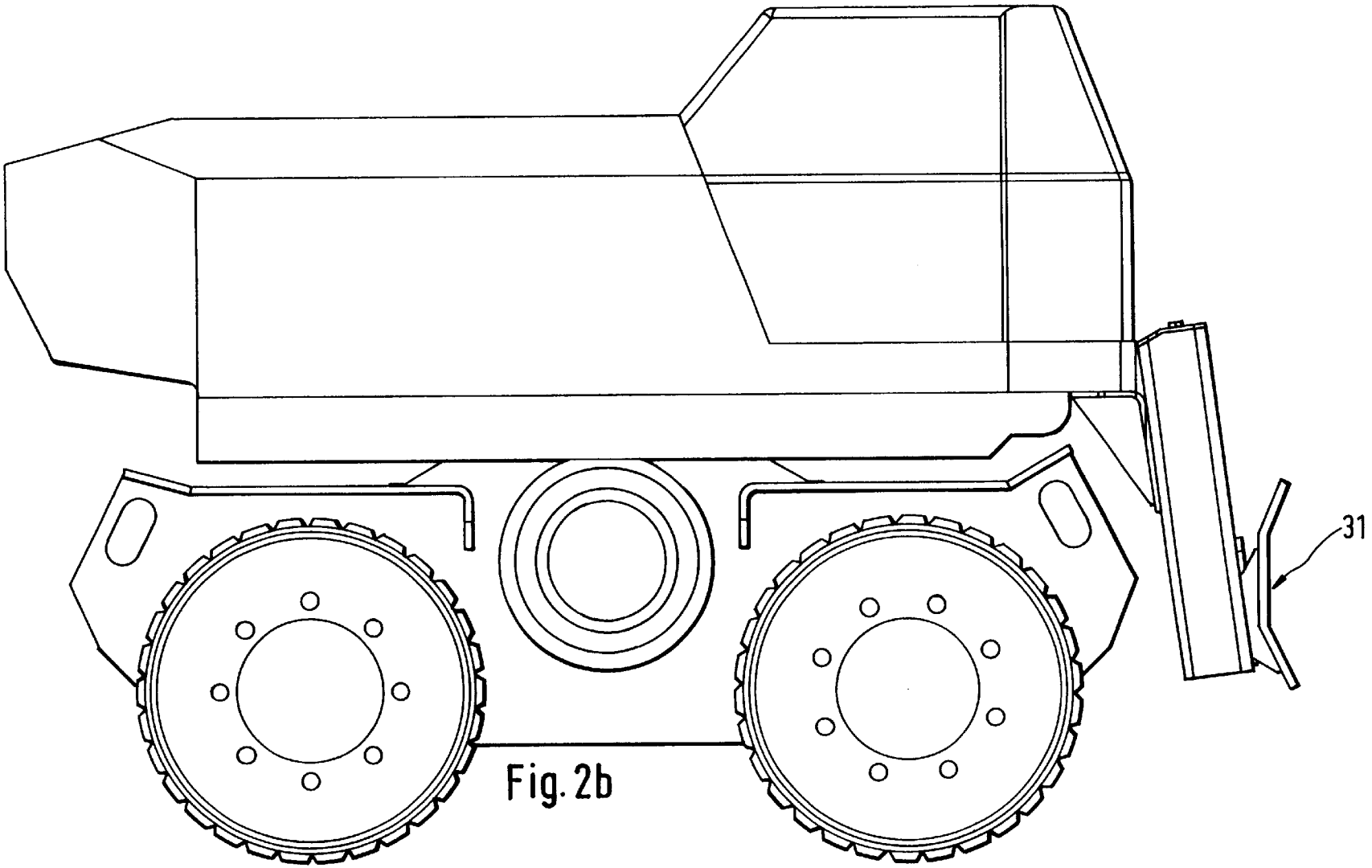

FIGS. 2*a* and 2*b* show a further embodiment of a roller vehicle which is identified as reference numeral 30. The roller vehicle 30 has a lifting device 32 for moving a levelling device 31 upwardly in FIG. 2*b* and downwardly in FIG. 2*a*. The lifting device 32 can be formed for example by a telescopable extendable and retractable cylinder-piston unit. It is to be understood that other embodiments of the lifting device 30 are possible as well. The upper end of the lifting device 32 is arranged closer to the vehicle than the lower end of the lifting device 32. As a result, the levelling device 31 is liftable and lowerable with an inclination upwardly relative to the vehicle, so that despite the displaced ground, the levelling device 31 can be moved back upwardly. Furthermore, a not shown support can be provided on the lifting device 32, to prevent bending of the lifting device 32 during levelling.

It will be understood that each of the elements described above, or two or more together, may also find a useful application in other types of constructions differing from the types described above.

While the invention has been illustrated and described as embodied in roller vehicle for ground compaction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A roller vehicle for ground compaction, comprising a lower ground compacting means operating for compacting ground; leveling means operative for leveling the ground; an upper part which is vibration uncoupled from said lower ground compacting means, said leveling means being mounted on said vibration uncoupled upper part and being liftable and lowerable; means for lifting and lowering said leveling means and including at least one lifting device which is formed as a telescopable extendable and retractable cylinder unit and is inclined so as to be lifted inclined upwardly a support for said leveling means in its lower position after lowering, to prevent bending of said lifting device during leveling; a circuit for producing vibrations of said ground compacting means, and a circuit for lifting and lowering of said leveling means formed so that a same hydraulic oil circulates in said circuits, said upper part being clampable with said ground compacting means so that during leveling of a surface which is inclined at a predetermined angle relative to a horizontal by said leveling means, said upper part is not inclined.

2. A roller vehicle as defined in claim 1, wherein said planning means is formed as a blade.

3. A roller vehicle as defined in claim 1, wherein said planning means is turnable relative to a horizontal, in particular around its center point.

4. A roller vehicle as defined in claim 1, wherein said planning means is manually controllable.

5. A roller vehicle as defined in claim 1, wherein said planning means is remotely controllable.

6. A roller vehicle as defined in claim 5, wherein said levelling means is remotely controllable by radio.

7. A roller vehicle as defined in claim 5, wherein said levelling means is remotely controllable by infrared light.

* * * * *